US011465866B2

(12) United States Patent
Touchstone et al.

(10) Patent No.: US 11,465,866 B2
(45) Date of Patent: Oct. 11, 2022

(54) FILL INDICATOR CAMS FOR PRINTER TRAYS

(71) Applicant: Hewlett-Packard Development Company, L.P., Spring, TX (US)

(72) Inventors: Hallie Touchstone, Boise, ID (US); Bradley Spencer White, Boise, ID (US); Robert C. Lopez, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,754

(22) PCT Filed: Nov. 9, 2018

(86) PCT No.: PCT/US2018/060195
§ 371 (c)(1),
(2) Date: Dec. 29, 2020

(87) PCT Pub. No.: WO2020/096625
PCT Pub. Date: May 14, 2020

(65) Prior Publication Data

US 2021/0276817 A1 Sep. 9, 2021

(51) Int. Cl.
*B65H 1/04* (2006.01)

(52) U.S. Cl.
CPC ..... *B65H 1/04* (2013.01); *B65H 2402/545* (2013.01); *B65H 2405/1142* (2013.01);
(Continued)

(58) Field of Classification Search
CPC ..... B65H 1/04; B65H 2405/114; B65H 2405/1142; B65H 2405/11425;
(Continued)

(56) References Cited

U.S. PATENT DOCUMENTS 4,772,007 A 9/1988 Kashimura
5,078,379 A 1/1992 Leisner
(Continued)

FOREIGN PATENT DOCUMENTS

JP 04-059521 A 2/1992
JP 09-240887 A 9/1997
(Continued)

*Primary Examiner* — Prasad V Gokhale
(74) *Attorney, Agent, or Firm* — Perry + Currier Inc

(57) ABSTRACT

Example feed trays for a printer are disclosed. In one example, the feed tray includes a support surface to support print media, and a guide wall coupled to the support surface. The support surface and the guide wall define a feed path for the print media into the printer. In addition, the feed tray includes a fill indicator comprising a cam rotatably coupled to the guide wall about an axis of rotation that is perpendicular to the feed path. The cam includes an extension that extends radially from the axis of rotation, and the cam is rotatable about the axis of rotation between a first position and a second position. The extension is more proximate to the support surface when the cam is in the second position than when the cam is in the first position, and the cam is rotationally biased from the second position toward the first position.

14 Claims, 12 Drawing Sheets

(52) U.S. Cl.
CPC ..... *B65H 2511/12* (2013.01); *B65H 2511/22* (2013.01); *B65H 2801/06* (2013.01)

(58) Field of Classification Search
CPC ..... B65H 2405/1144; B65H 2405/115; B65H 2405/12; B65H 2405/141; B65H 2511/12; B65H 2402/545; B65H 2403/51
See application file for complete search history.

(56) References Cited

U.S. PATENT DOCUMENTS

| | | | | |
|---|---|---|---|---|
| 5,387,980 | A | 2/1995 | Baitz et al. | |
| 5,596,399 | A | 1/1997 | Dempsey et al. | |
| 6,050,565 | A | 4/2000 | Fetherolf | |
| 6,057,936 | A | 5/2000 | Obara et al. | |
| 6,206,362 | B1 | 3/2001 | Tan et al. | |
| 6,986,509 | B2 | 1/2006 | Koh et al. | |
| 7,159,863 | B2 * | 1/2007 | Murrell | B65H 1/04 271/145 |
| 7,374,163 | B2 | 5/2008 | Cook et al. | |
| 7,677,557 | B2 | 3/2010 | Ino | |
| 7,857,303 | B2 | 12/2010 | Oomori et al. | |
| 8,246,041 | B2 | 8/2012 | Gagnon et al. | |
| 8,393,613 | B2 * | 3/2013 | Chen | B65H 7/02 271/145 |
| 2007/0057428 | A1 | 3/2007 | Luo | |
| 2009/0206544 | A1 | 8/2009 | Allwright | |
| 2011/0037220 | A1 * | 2/2011 | Nishinakama | B65H 1/02 271/253 |
| 2013/0174753 | A1 | 7/2013 | Jeter | |
| 2016/0096699 | A1 * | 4/2016 | Wada | B65H 9/08 271/240 |
| 2017/0001819 | A1 * | 1/2017 | Shiba | B65H 1/266 |

FOREIGN PATENT DOCUMENTS

| | | | |
|---|---|---|---|
| JP | 3284476 | B2 | 5/2002 |
| WO | 2018/048451 | A1 | 3/2018 |

* cited by examiner

FILL INDICATOR CAMS FOR PRINTER TRAYS

BACKGROUND

Printers may employ feed trays for the storage of print media (e.g., paper) that is used for printing operations. Such trays may be disposed internally to the printer or externally (e.g., such as a printing tray that folds out from the side of a printer housing). Regardless of the precise location of the feed tray, during a printing operation, print media is drawn from the feed tray into the printer, and an image is deposited thereon.

BRIEF DESCRIPTION OF THE DRAWINGS

Various examples will be described below referring to the following figures.

DETAILED DESCRIPTION

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As used herein, including in the claims, the word "or" is used in an inclusive manner. For example, "A or B" means any of the following: "A" alone, "B" alone, or both "A" and "B." In addition, when used herein (including the claims) the words "generally," "about," "approximately," or "substantially" mean within a range of plus or minus 20% of the stated value.

As previously described above, printers may employ feed trays for the storage of print media. Various parameters, such as the physical size and shape of the feed tray, the size and shape of the opening into the printer, and the position and range of motion of rollers or other components for drawing the print media into the printer during a printing operation, among others, impose a stack height limit for print media stored or inserted within the feed tray. If the print media is loaded within the feed tray above the stack height limit, subsequent printing operations may be frustrated due to, for example, jamming or skewing of the print media due to the oversized stack within the feed tray. Accordingly, examples disclosed herein include fill indicators for a printer feed tray that provide a physical barrier to prevent (or at least discourage) the insertion of print media into the feed tray above the stack height limit.

Figure 1:
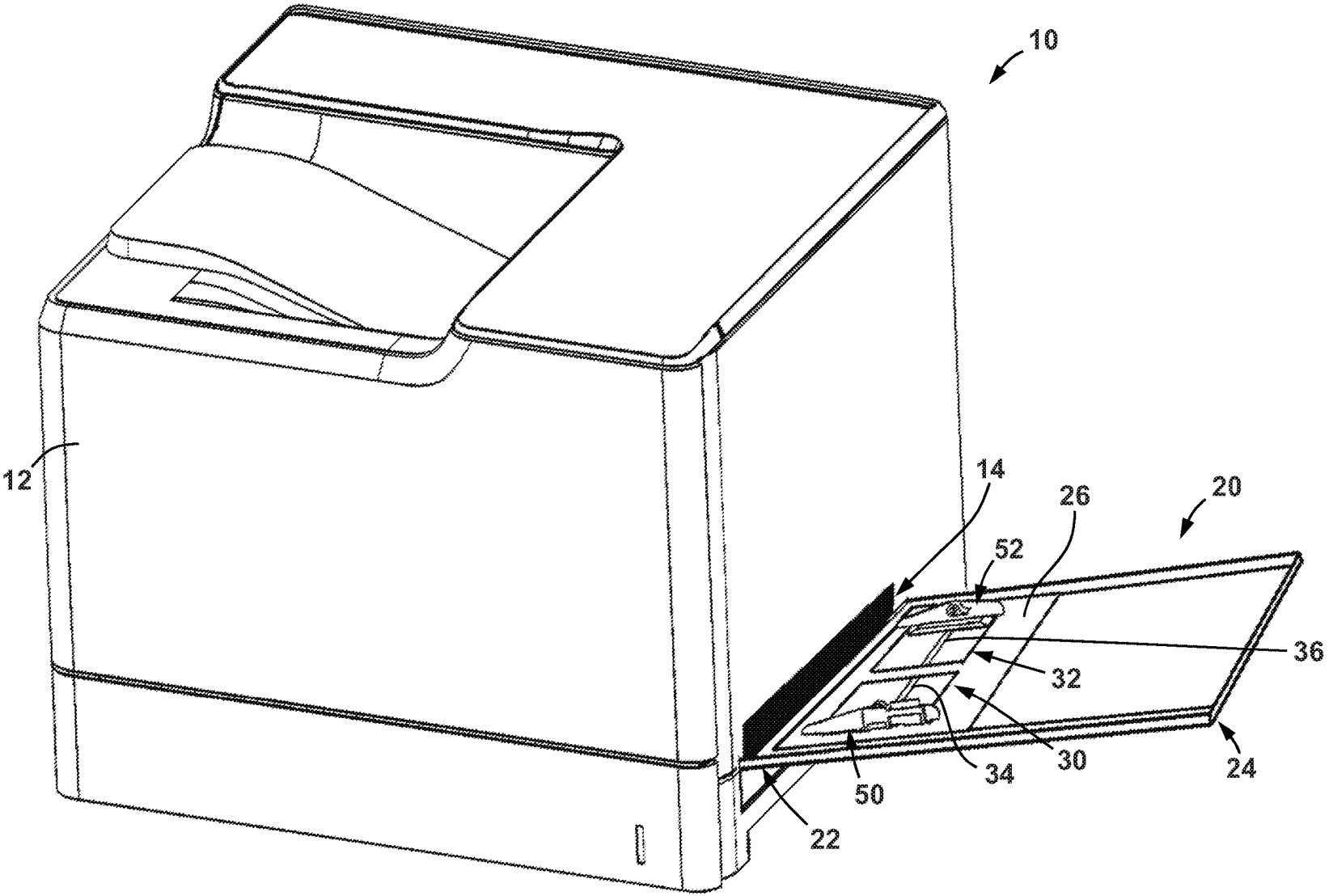
FIG. 1 is a perspective view of a printer according to some examples.

Referring now to FIG. 1, a printer 10 according to some examples is shown. Printer 10 may be any suitable printing device, such as, for example, an inkjet printer, a laser printer, a dot-matrix printer, etc. In this example, printer 10 generally includes a housing 12 and an external feed tray 20.

Figure 2:
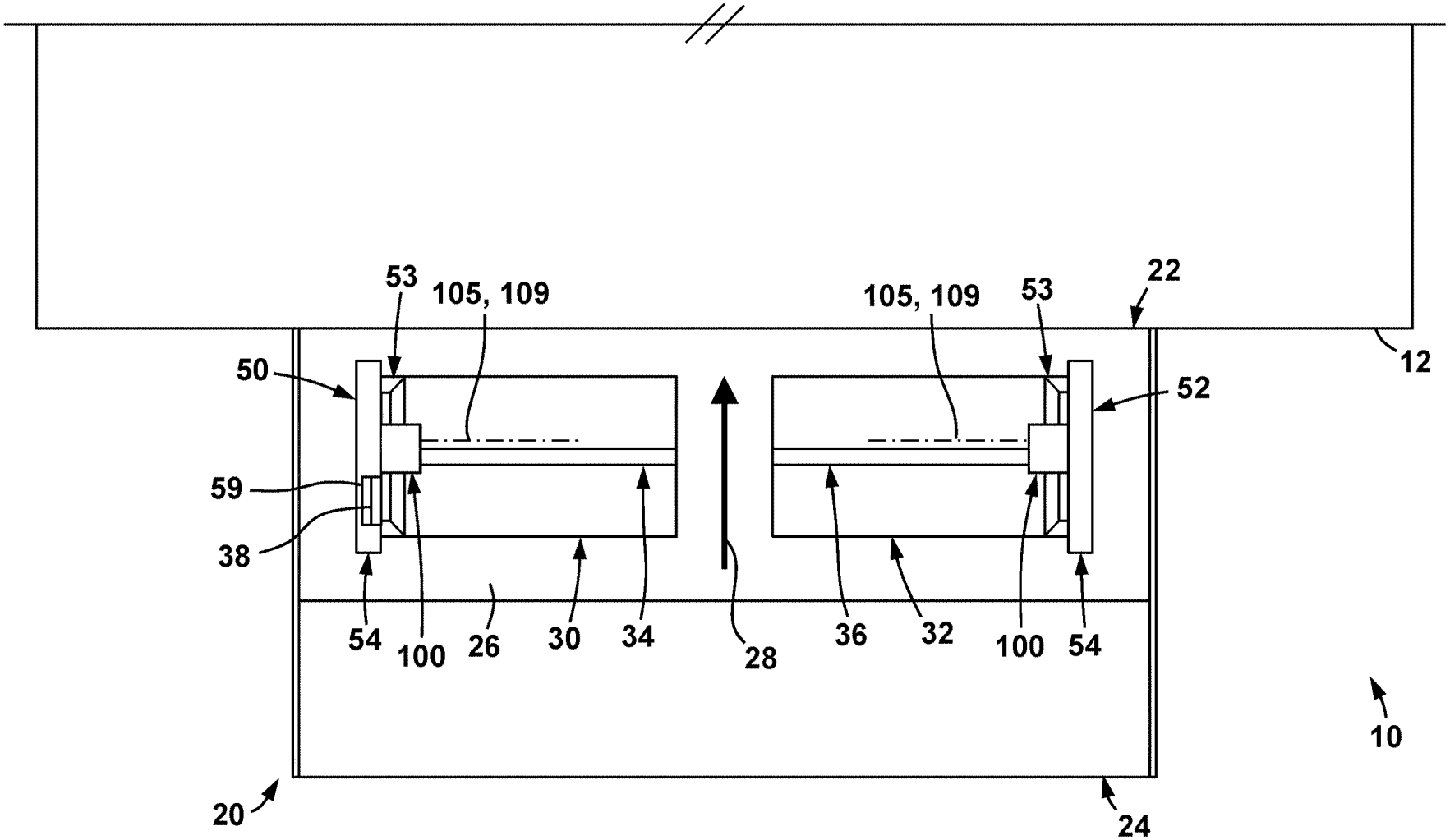
FIG. 2 is a schematic top view of a feed tray of the printer of FIG. 1 according to some examples.

Referring now to FIGS. 1 and 2, feed tray 20 includes a first or proximal end 22, and a second or distal end 24 opposite proximal end 22. In this example, feed tray 20 is a fold-out side feed tray for printer 10, and thus, proximal end 22 is rotatably coupled to housing 12, such that feed tray 20 may be transitioned between a folded position (where distal end 24 is disposed proximate or against housing 12) and a deployed position (where distal end 24 is extended away from housing 12). FIGS. 1 and 2 depict feed tray 20 in the deployed position.

In addition, feed tray 20 includes a support surface 26 disposed between ends 22, 24. As will be described in more detail below, support surface 26 is to support a stack of print media thereon such that the print media may be drawn (e.g., by rollers or other components that are not directly shown in FIG. 1) into an opening 14 in printer housing 12 adjacent feed tray 20 during a printing operation. Further, feed tray 20 includes a pair of side guides coupled to support surface 26—particularly a first side guide 50, and a second side guide 52. Side guides 50, 52 are to laterally guide the print media on support surface 26 to facilitate proper feeding thereof during a printing operation. Side guides 50, 52 are disposed within corresponding recesses 30, 32, respectively, in support surface 26, and are movable relative to support surface 26 via a pair of corresponding slots 34, 36, respectively.

As best shown in FIG. 2, support surface 26 and side guides 50, 52 (particularly the guide walls 54 of side guides 50, 52, as described in more detail below) define a feed path 28 across support surface 26 and into opening 14 (see FIG. 1) of printer housing 12. During a printing operation, print media (not shown in FIG. 1) is disposed upon support surface 26 between side guides 50, 52 and is drawn into opening 14 along feed path 28 by a suitable device or mechanism (e.g., feed roller(s)—not shown).

In this example, feed tray 20 may receive multiple sizes (e.g., widths) of print media. As a result, the side guides 50, 52 are to move relative to support surface 26 along slots 34, 36, respectively, in a direction that is generally perpendicular to the feed path 28 (as a result, slots 34, 36 are generally oriented perpendicularly to feed path 28). In this example, first side guide 50 has a latch or button 38 that may be manipulated (e.g., depressed, pulled, etc.) to allow side guides 50, 52 to traverse along slots 34, 36, respectively. Because the mechanism allowing the adjustment or movement of side guides 50, 52 is not pertinent to the current disclosure, further details are not provided herein. In addition, it should be appreciated that in other examples, one of the side guides 50, 52 is to move along support surface 26, rather than both as in this example. Further, in still other examples, neither of the sides guides 50, 52 are to move along support surface 26.

Figure 3:
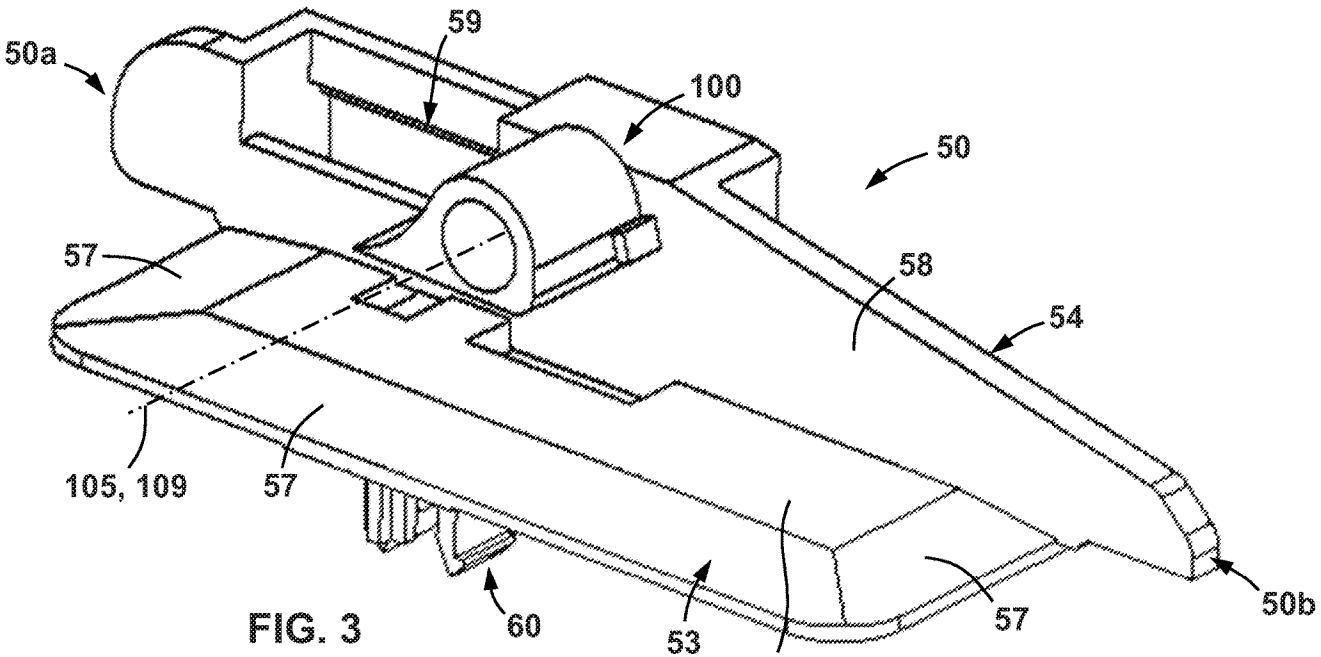
FIGS. 3 and 4 are perspective views of a first side guide for use within the feed tray of FIG. 2 according to some examples.
Figure 4:
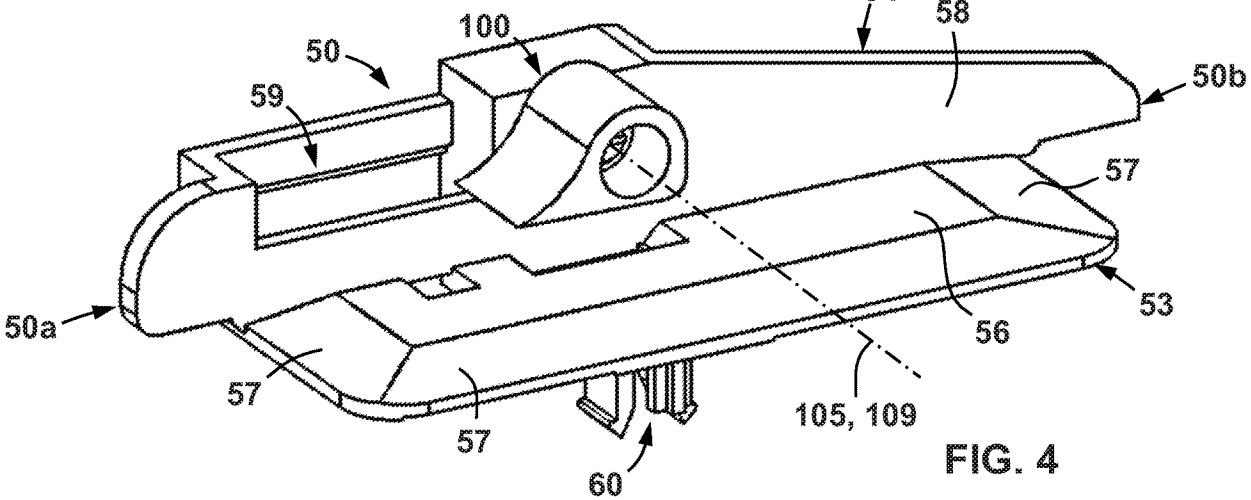
Figure 5:
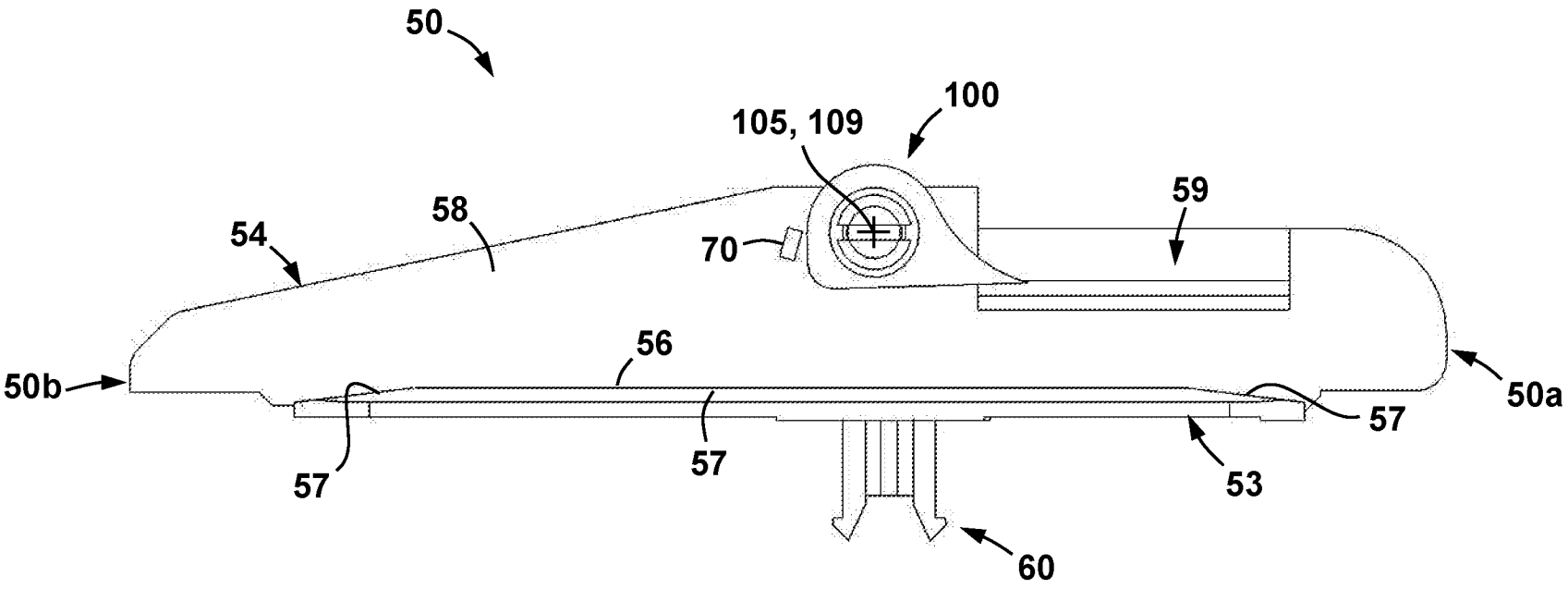
FIG. 5 is a side view of the first side guide of FIGS. 3 and 4.

Referring now to FIGS. 3-5, first side guide 50 includes a first end 50*a*, a second end 50*b* opposite first end 50*a*, a base 53 and a guide wall 54. Base 53 includes a planar base surface 56 and a plurality of ramped surfaces 57 extending from planar base surface 56. Referring briefly again to FIGS. 1 and 2, because side guides 50, 52 are disposed within recesses 30, 32, respectively, as previously described, planar base surface 56 may be co-planar with the support surface 26. However such alignment does not always occur, and in other examples, base surface 56 is either above or below support surface 26 of feed tray 20, but even in some of these examples, planar base surface 56 may be parallel to support surface 26.

Referring still to FIGS. 3-5, a connector 60 extends from base 53, opposite planar base surface 56. First side guide 50 is coupled to feed tray 20 by inserting connector 60 through the corresponding slot 34 disposed in recess 30 in support surface 26 (see FIG. 2).

Guide wall 54 defines a planar surface 58 extending between ends 50*a*, 50*b*. In this example, planar surface 58 is perpendicular to planar base surface 56 of base 53. In this example, a recess 59 extends into planar surface 58 on first side guide 50. Recess 59 receives latch 38 therethrough that is to selectively allow movement of first side guide 50 along support surface 26 as previously described.

Referring still to FIGS. 3-5, a fill indicator 100 is coupled to planar surface 58 of guide wall 54 (via a shaft 120 extending from planar surface 58 as will be described in more detail below—see FIG. 13) that is rotatable about an axis of rotation 105. As shown in FIG. 2, axis 105 extends perpendicularly to feed path 28 when first side guide 50 is installed on support surface 26. Further details of fill indicator 100 will be described in more detail below.

Figure 6:
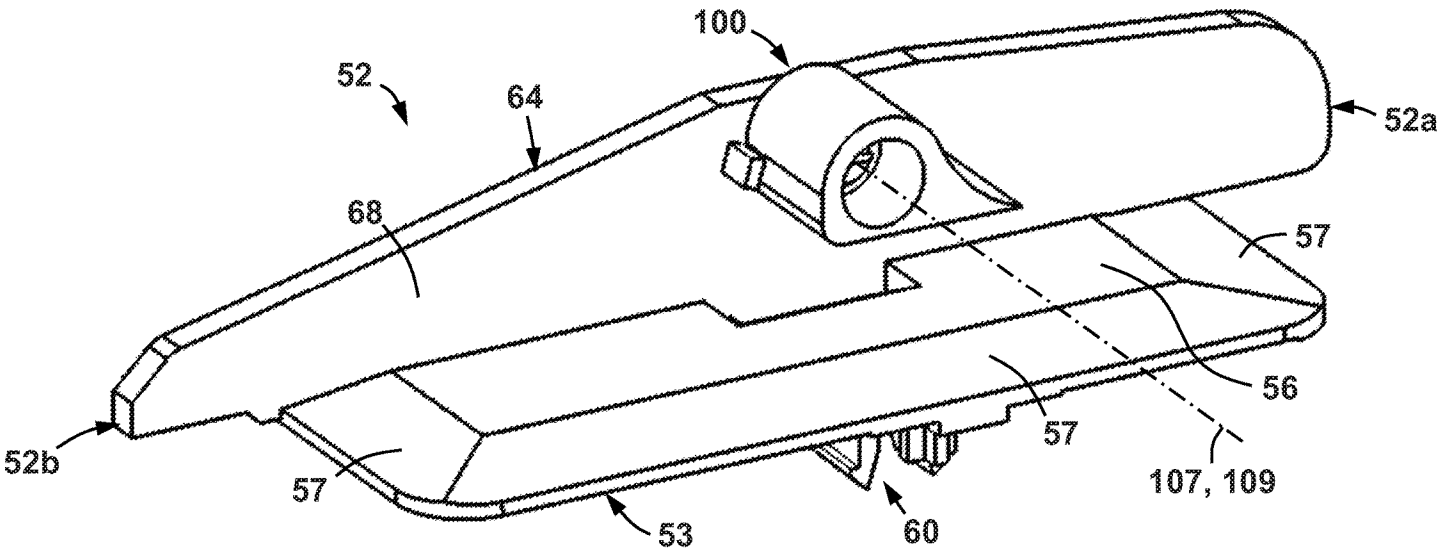
FIGS. 6 and 7 are perspective views of a second side guide for use within a feed tray of FIG. 2 according to some examples.
Figure 7:
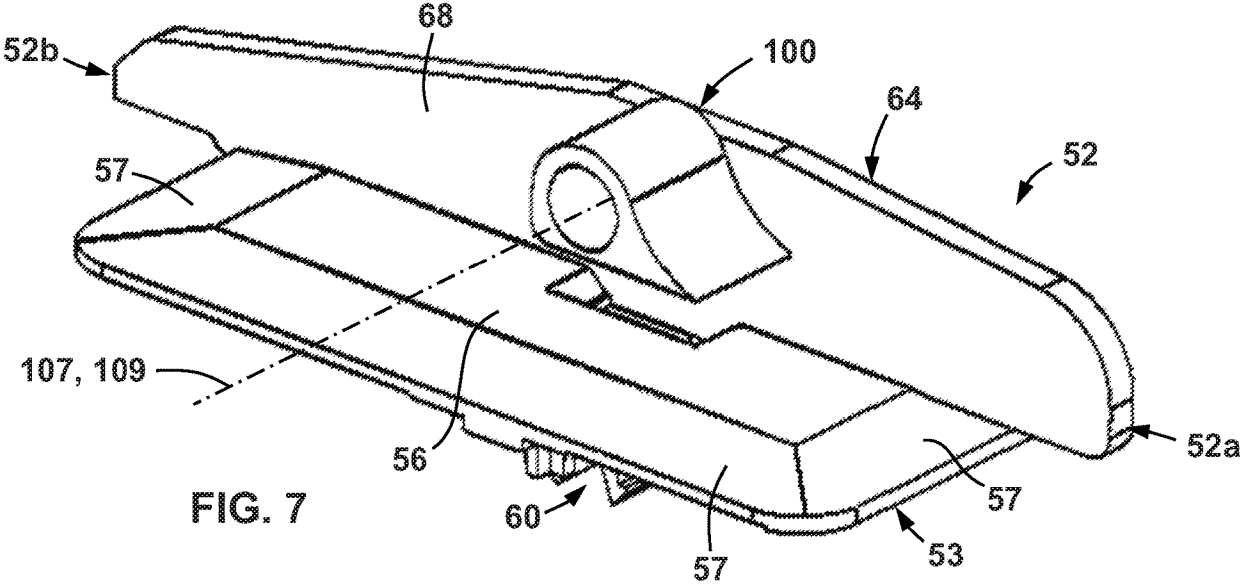
Figure 8:
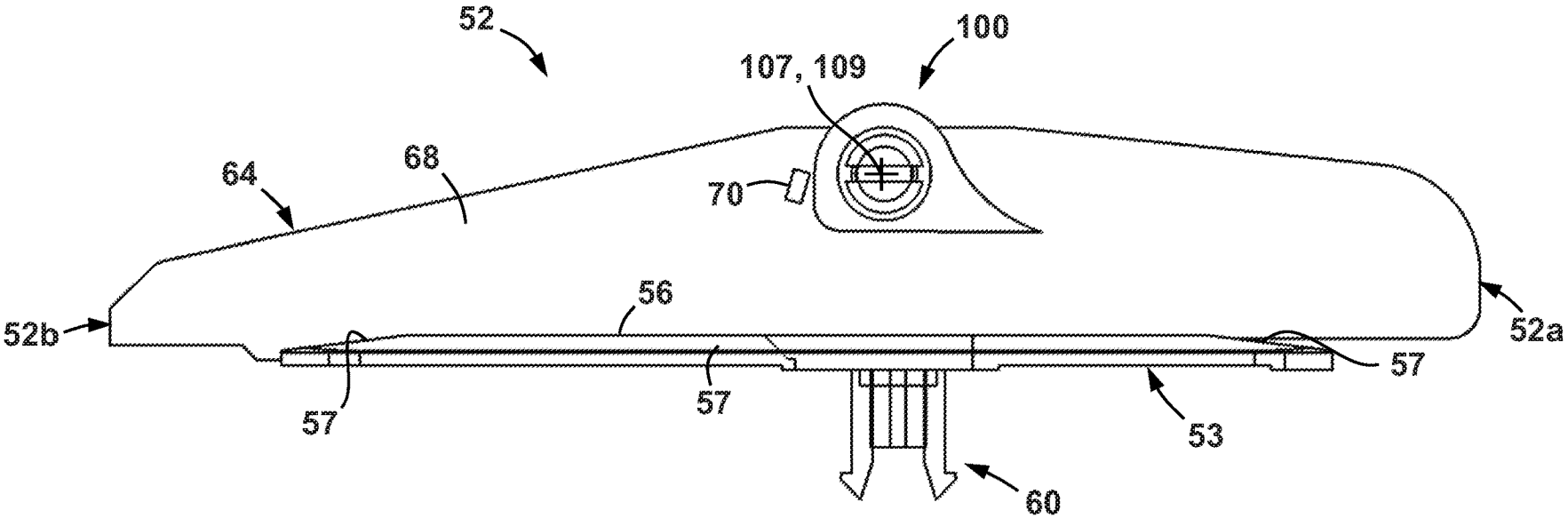
FIG. 8 is a side view of the second side guide of FIGS. 6 and 7.

Referring now to FIGS. 6-8, second side guide 52 is substantially the same as first side guide 50, and thus, like features are identified with like components and the description below will focus on the features of second side guide 52 that are different from first side guide 50. In particular, second side guide 52 includes a first end 52*a*, and a second end 52*b* opposite first end 52*a*. In addition, second side guide 52 includes base 53, connector 60, and guide wall 54, except that guide wall 54 does not include recess 59. As with planar surface 58 on first side guide 50, planar surface 58 on second side guide 52 extends perpendicularly to planar base surface 56 on base 53 between ends 52*a*, 52*b*. In addition, connector 60 on second side guide 52 is to engage within the corresponding slot 36 rather than slot 34 for first side guide 50.

Further, a fill indicator 100 (which is the same as fill indicator 100 on first side guide) is also coupled to planar surface 58 of guide wall 54 of second side guide 52 (again via a shaft 120 extending from planar surface 58 as will be described in more detail below—see FIG. 13) that is rotatable about a corresponding axis of rotation 105. As shown in FIG. 2, axis 105 of second side guide 52 extends perpendicularly to feed path 28 when second side guide 52 is installed on support surface 26. In addition, in this example, axes 105 of side guides 50, 52 (see FIG. 2) are generally aligned with one another. The details regarding the fill indicator 100 on the side guides 50, 52 will be described in more detail below.

Referring now to FIGS. 9-12, an example fill indicator 100 for use on side guides 50, 52 is shown. In this example, the fill indicator 100 included on side guide 50 is the same as the fill indicator 100 disposed on second side guide 52. Thus, the same description (e.g., the following description with reference to FIGS. 9-12) is applicable to fully describe fill indicator 100 as it appears on both side guides 50, 52.

Figure 10:
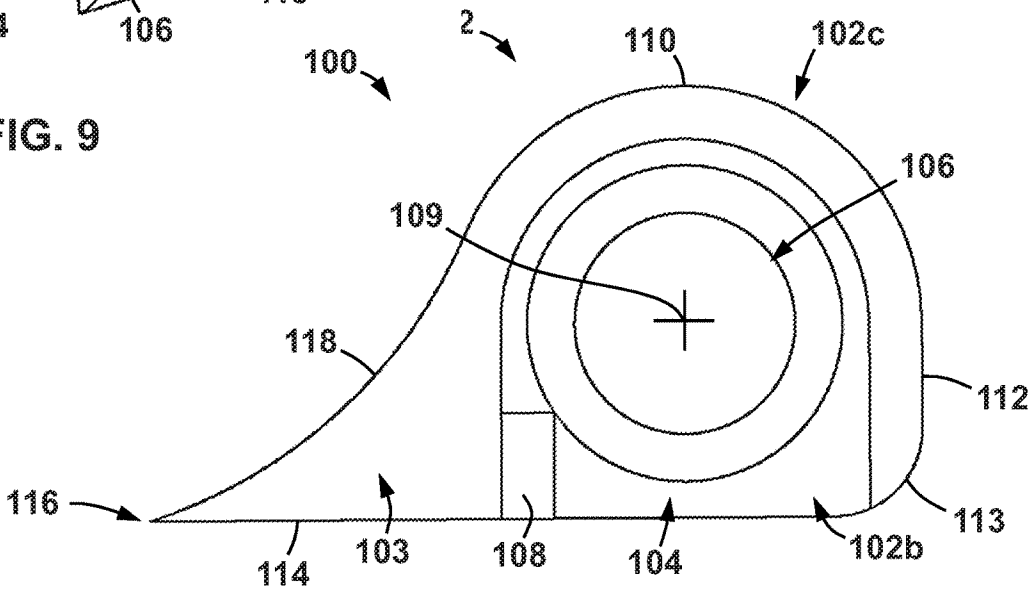
FIG. 10 is a side view of the cam of FIG. 9.

In this example, fill indicator 100 comprises a cam 102 including a longitudinal axis 109, a first or front side 102*a*, and a second or back side 102*b* opposite front side 102*a*. In addition, cam 102 includes a radially outer surface extending axially between sides 102*a*, 102*b* with respect to axis 109. As best shown in FIG. 10, radially outer surface 102*c* comprises a first planar surface 112, a second planar surface 114, and a convex arcuate surface 113 extending between planar surfaces 112, 114. Accordingly, convex arcuate surface 113 is angularly disposed between the planar surfaces 112, 114 about axis 109. In addition, in this example, planar surfaces 112, 114 extend perpendicularly to one another; however, such alignment does not always occur. Radially outer surface 102*c* also comprises a concave arcuate surface 118 extending from second planar surface 114, and a cylindrical surface 110 extending from concave arcuate surface 118 to first planar surface 112. Thus, concave arcuate surface 118 is angularly disposed between second planar surface 114 and cylindrical surface 110 about axis 109, and cylindrical surface 110 is angularly disposed between concave arcuate surface 118 and first planar surface 112 about axis 109.

Referring still to FIGS. 9-12, together concave arcuate surface 118 and second planar surface 114 define an extension 103 that extends radially (or generally radially) outward from axis 109 to a distal edge 116. In this example, distal edge 116 is defined at the intersection of concave arcuate surface 118 and second planar surface 114 and extends axially between sides 102*a*, 102*b* with respect to axis 109.

Figure 9:
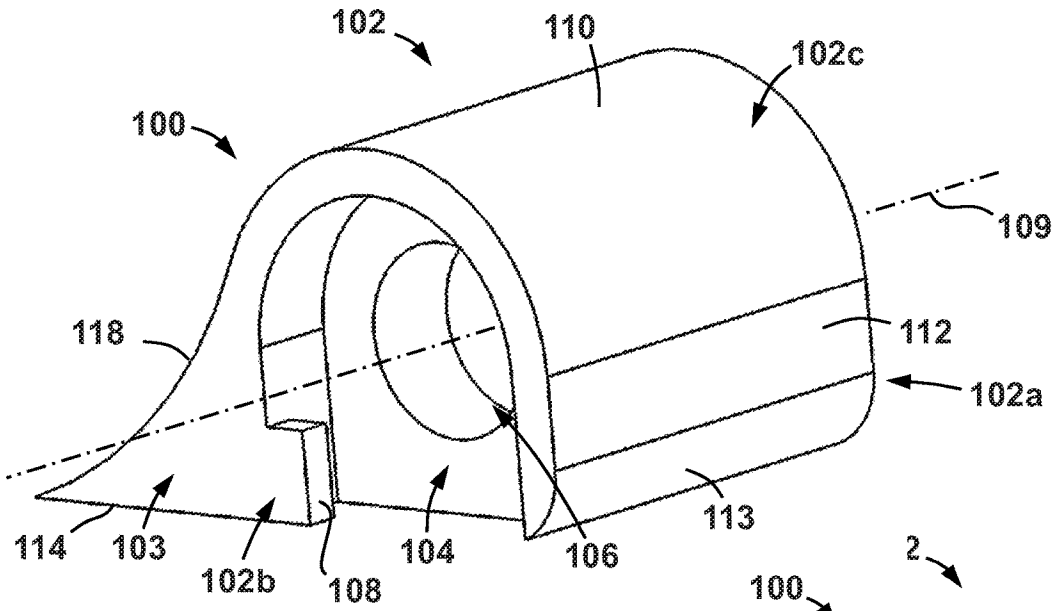
FIG. 9 is a perspective view of a cam for use on the side guides of FIGS. 3-8 according to some examples.
Figure 11:
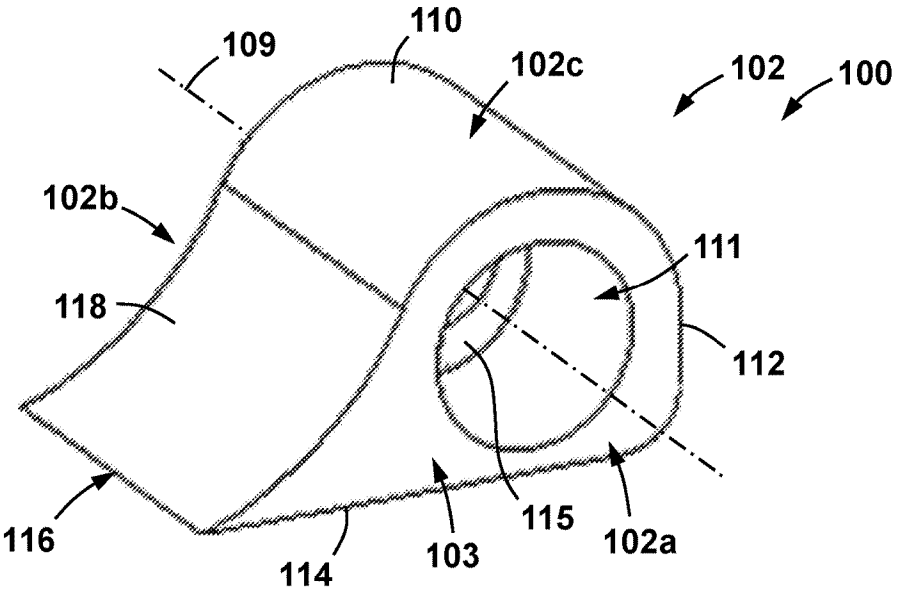
FIGS. 11 and 12 are additional perspective views of the cam of FIG. 9.
Figure 12:
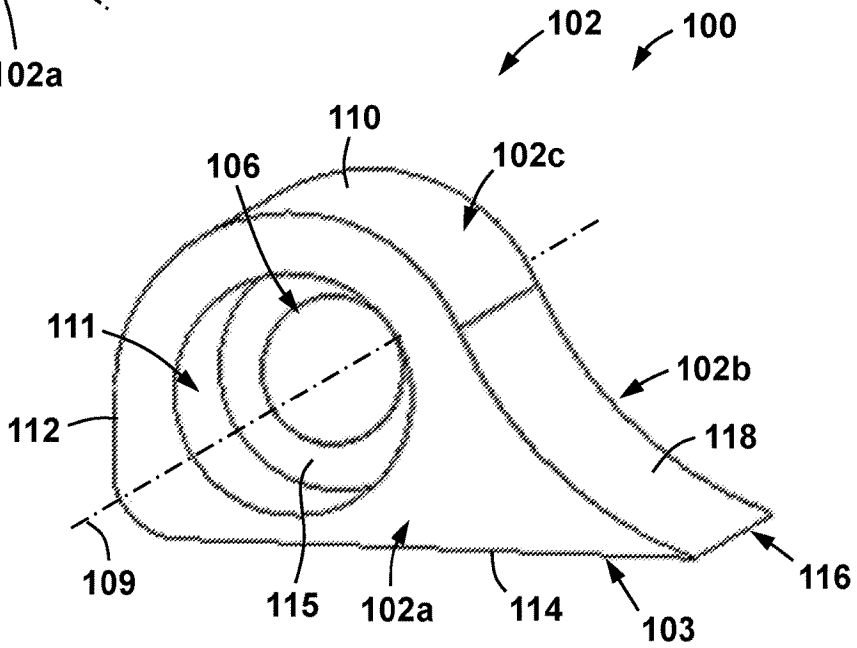

In addition, cam 102 includes a first cavity or recess 111 extending axially therein from front side 102*a*, a second cavity or recess 104 extending axially therein from back side 102*b*, and a throughbore 106 extending axially between recesses 111, 104. Due to the positioning of recesses 104, 111 and sides 102*a*, 102*b*, first recess 111 may be referred to herein as a front recess 111 and second recess 104 may be referred to herein as a back recess 111. As best shown in FIGS. 11 and 12, an annular shoulder 115 is defined within front recess 111 that extends angularly about throughbore 106 with respect to axis 109. Additionally, as is best shown in FIGS. 9 and 10, back recess 104 includes an engagement projection 108.

Figure 13:
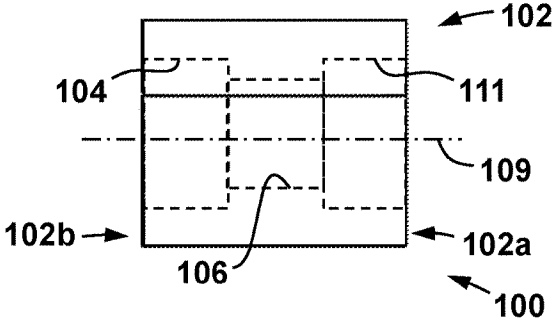
FIG. 13 is an exploded view of the cam of FIGS. 9-12 and the first side guide of FIGS. 3-5.
Figure 13:
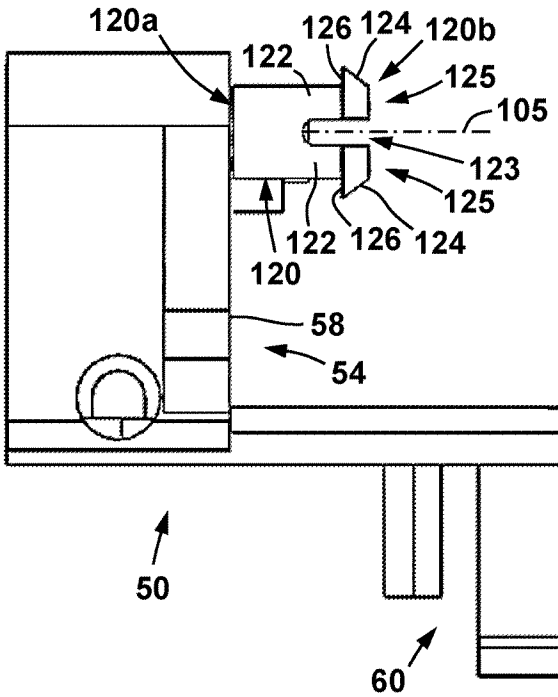
Figure 14:
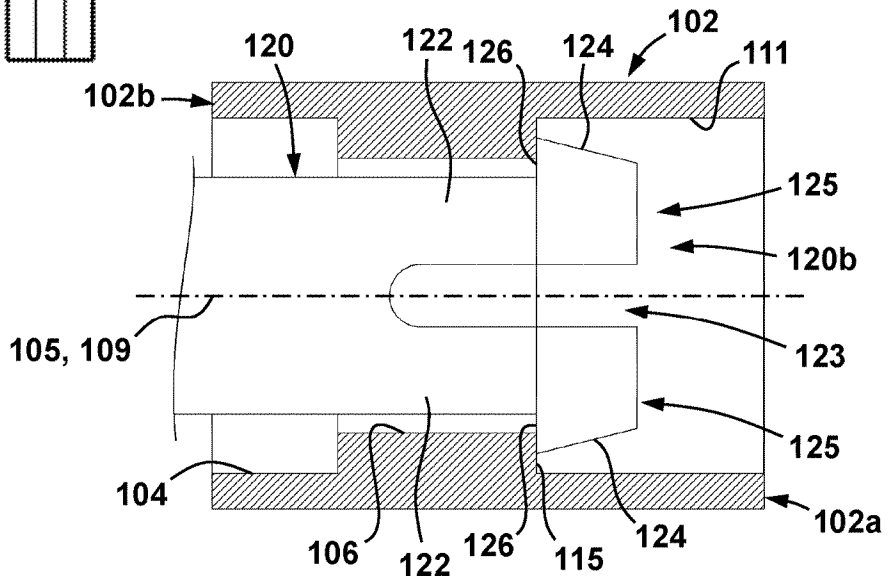
FIG. 14 is an enlarged cross-sectional view of the cam of FIGS. 9-12 installed on a shaft of the first side guide of FIGS. 3-5.

Referring now to FIGS. 13 and 14, the assembly of cam 102 on first side guide 50 is shown, it being understood that the installation of the cam 102 of the other fill indicator 100 coupled to second side guide 52 is accomplished in the same manner (and thus is not specifically shown in the interest of brevity). As shown in FIG. 13, cam 102 is mounted to planar surface 58 of guide wall 54 by inserting a shaft 120 extending from planar surface 58 into and through the aligned recesses 104, 111, and throughbore 106 such that axis 109 of cam 102 is aligned with axis 105.

Shaft 120 includes a first or proximal end 120*a*, and a second or distal end 120*b* opposite proximal end 120*a* along axis 105. Proximal end 120*a* is mounted to planar surface 58, and distal end 120*b* is axially spaced from planar surface 58 along axis 105. A slot or recess 123 extends axially into shaft 120 from distal end 120*b*, thereby defining a pair of collets or fingers 122 extending axially from distal end 120*b*. Each collet 122 includes an engagement member 125 at distal end 120*b* that defines a frustoconical surface 124 and an annular shoulder 126. In this example, frustoconical surface 124 is axially disposed between annular shoulder 126 and distal end 120*b* (i.e., annular shoulder 126 is axially disposed between frustoconical surface 124 and proximal end 120*a*).

During installation of cam 102, distal end 120*b* of shaft 120 is advanced axially through back recess 104, throughbore 106, and into front recess 111 along aligned axes 105, 109. Upon entering throughbore 106, frustoconical surface 124 on the engagement member 125 on each collet 122 slidingly engages with the inner wall of throughbore 106 so that collets 122 are deflected radially inward toward axes 105, 109. As a result, distal end 120*b* of shaft 120 is able to advance axially within throughbore 106 until each engagement member 125 emerges into front recess 111, at which time collets 122 spring or move radially outward so that annular shoulder 126 on each engagement member 125 radially overlaps with annular shoulder 115 in front recess 111. Accordingly, upon entering front recess 111, shaft 120 is prevented from being axially withdrawn back through throughbore 106 and back recess 104 by the engagement of annular shoulders 126 and 115 of shaft 120 and cam 102, respectively.

Figure 15:
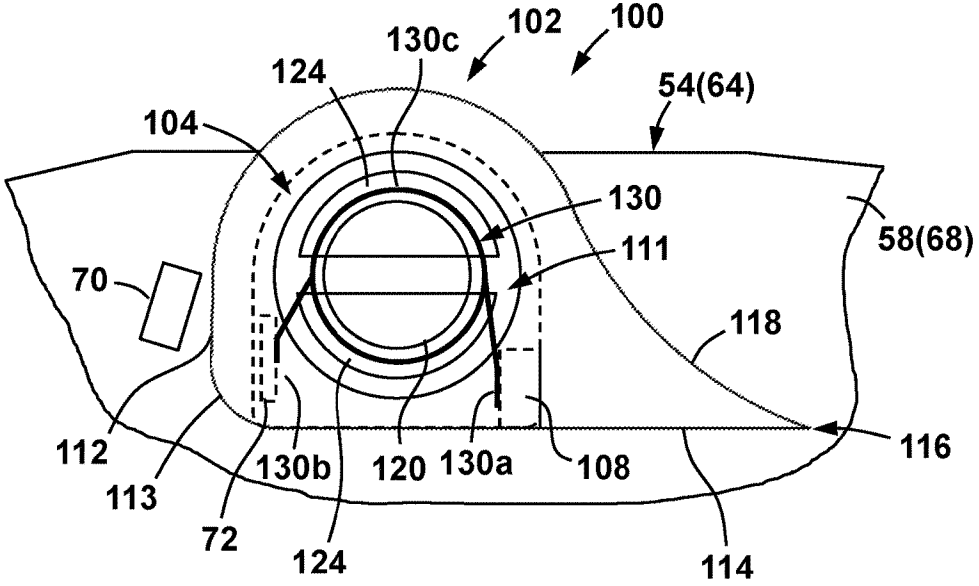
FIGS. 15 and 16 are sequential views of the cam of FIGS. 9-12 translating between a first position and a second position.
Figure 16:
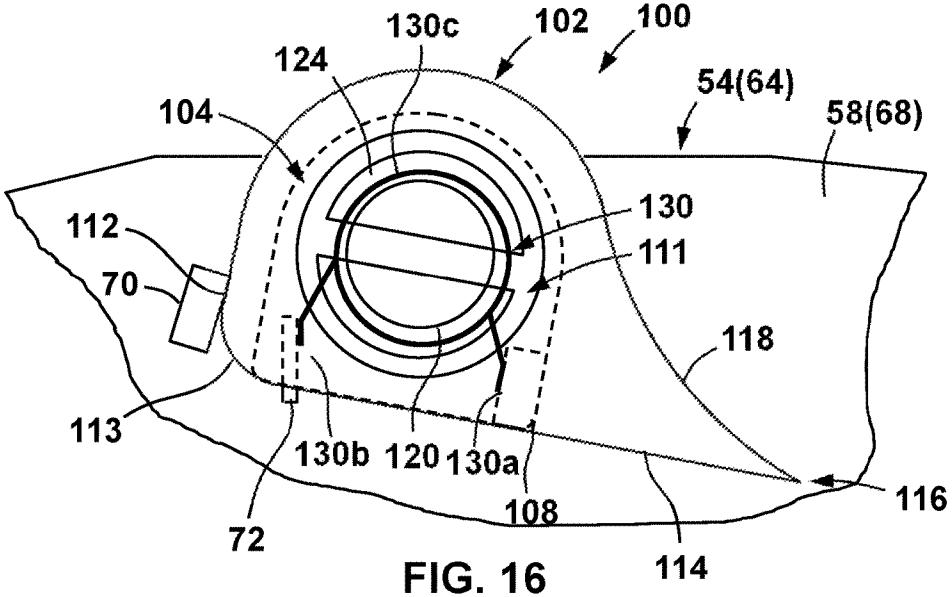

Referring now to FIGS. 15 and 16, during operations each cam 102 (that is the cam 102 coupled to first side guide 50, and the cam 102 coupled to second side guide 52—see FIG. 2) may be rotationally transitioned between a first position (see FIG. 15) and a second position (see FIG. 16). In the first position, planar surface 114 may be parallel (or substantially parallel) with planar base surface 56 of base 53 (see FIGS. 3-8). Because planar base surface 56 may be parallel or co-planar with support surface 26 of feed tray 20 as previously described above (see FIGS. 1 and 2), when cam 102 is in the first position of FIG. 15, planar surface 114 may also be parallel (or substantially parallel) with support surface 26. However, it should be appreciated that such alignment between surfaces 114, 26, 56 may not exist in other examples.

In the second position (see FIG. 16) cam 102 is rotated about axes 105, 109 so that distal edge 116 is transitioned or rotated toward (e.g., downward) planar base surface 56 from the first position (FIG. 15). In the views depicted in FIGS. 15 and 16, the cam 102 is rotated clockwise from the first position (FIG. 15) to the second position (FIG. 16). As will be described in more detail below, distal edge 116 of cam 102 is closer (or more proximate) to planar base surface 56 of base 53, and is thus also closer to support surface 26 of tray 20 (see FIGS. 1 and 2), when cam 102 is in the second position (FIG. 16), than when cam 102 is in the first position (FIG. 15). In addition, when cam 102 is in the second position of FIG. 16, planar surface 112 is engaged with another projection or stop 70 that extends from planar surface 58 of guide wall 54 of the corresponding side guide 50, 52. Thus, rotation of cam 102 beyond the second position of FIG. 16 is prevented by the engagement of planar surface 112 and projection 70.

Referring still to FIGS. 15 and 16, cam 102 is rotationally biased about shaft 120 toward the first position of FIG. 15. Specifically, in this example, cam 102 is rotationally biased about shaft 120 with a torsion spring 130. Torsion spring 130 includes a first end 130*a*, a second end 130*b*, and a body 130*c* extending between ends 130*a*, 130*b*. First end 130*a* is engaged with projection 108 formed in back recess 104 (see FIGS. 9 and 10), and second end 130*b* is engaged with a projection 72 extending outward from planar surface 58 of guide wall 54. In addition, body 130*c* extends angularly (e.g., helically) about shaft 120 between ends 130*a*, 130*b* and may be disposed within back recess 104 of cam 102 (see FIGS. 9 and 10).

When distal edge 116 of cam 102 is deflected downward toward planar base surface 56 (and support surface 26) (see FIGS. 1-8), first end 130*a* of torsion spring 130 is also deflected angularly toward second end 130*b* via the engagement between end 130*a* and projection 108 on cam 102. As a result of this relative deflection of ends 130*a*, 130*b*, body 130*c* exerts a biasing torsion to urge ends 130*a*, 130*b* angularly apart from one another so that cam 102 is rotationally biased back toward the first position (FIG. 15). Accordingly, if a load is applied to cam 102 that results in a deflection of cam 102 to the second position of FIG. 16, the removal of the load allows cam 102 to return to the first position of FIG. 15 under the bias of torsion spring 130.

Figure 17:
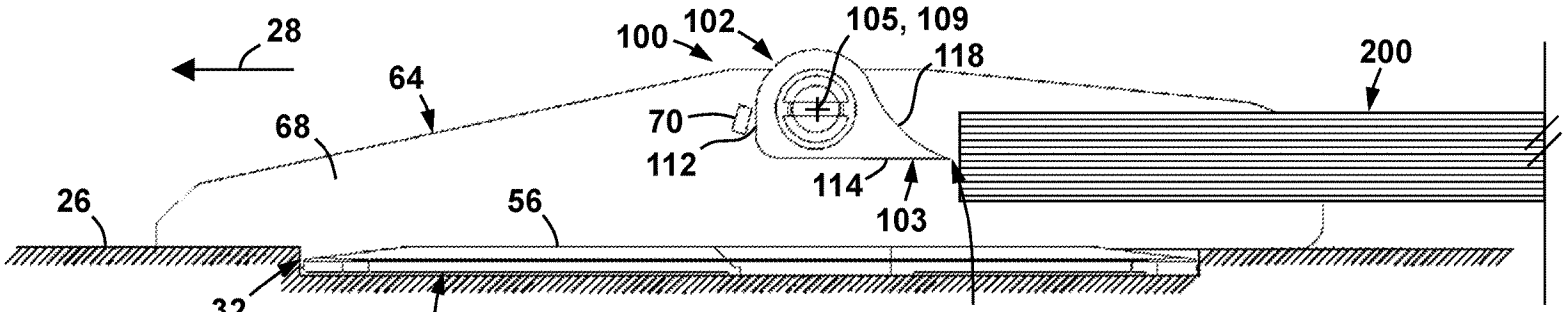
FIGS. 17-19 are sequential views of print media being loaded or installed within the feed tray of FIG. 2.
Figure 18:
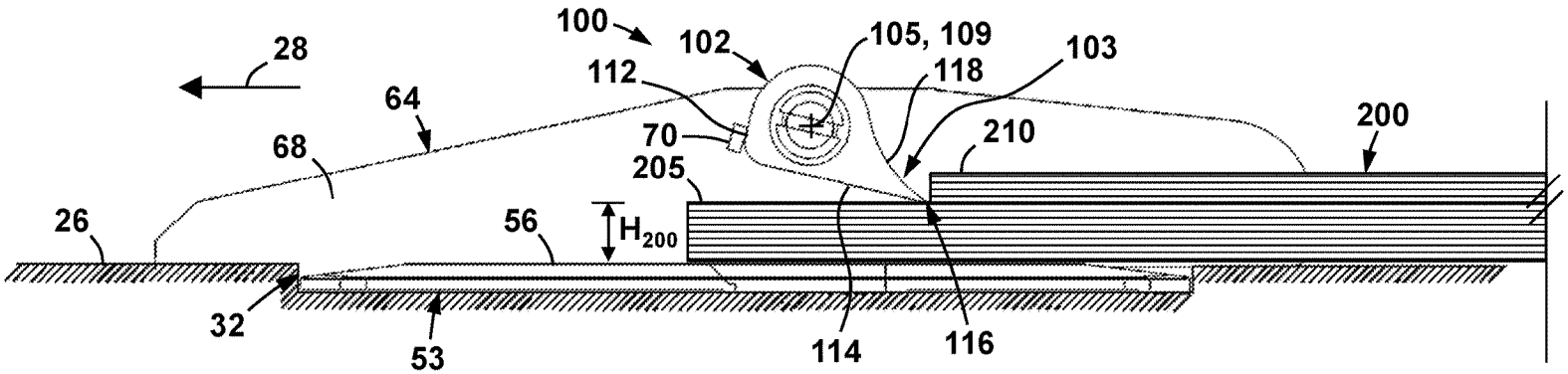
Figure 19:
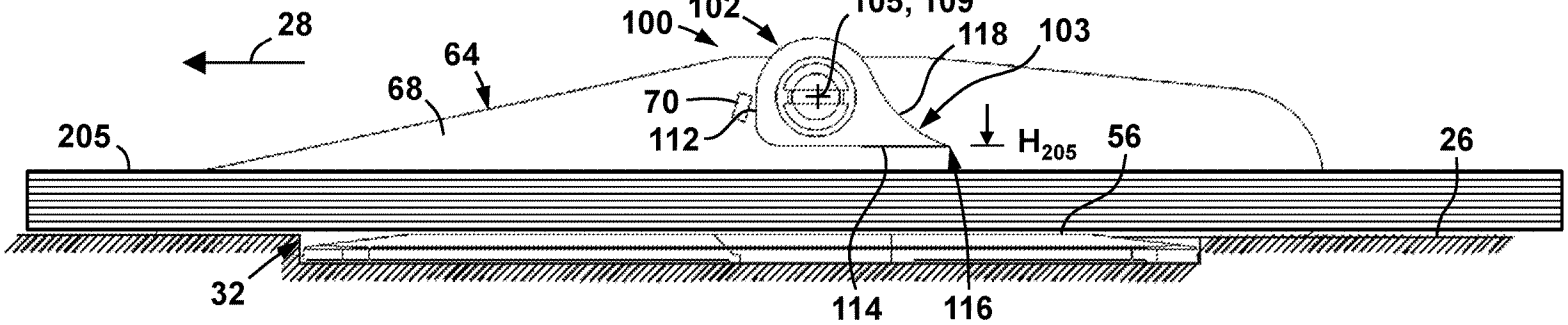

Referring now to FIGS. 1, 2, and 17-19, an example sequence for loading print media 200 into feed tray 20 is shown. FIGS. 17-19 depicts second side guide 52 and the corresponding fill indicator 100 disposed thereon, but does not depict first side guide 50 and the corresponding fill indicator 100 disposed therein in order to simply FIGS. 14 and 15. However, it should be appreciated that the interaction between print media 200 and the fill indicator 100 installed on first side guide 50 is the same. Thus, while FIGS. 17-19 show fill indicator 100 disposed on second side guide 52, it should be appreciated that the fill indicator 100 (and cam 102) disposed on first side guide 50 experiences the same deflection during the depicted sequence.

Generally speaking, when a user inserts or loads print media 200 into feed tray 20, the print media 200 may engage with the respective cam 102 on each side guide 50, 52, so that each cam 102 is deflected from the first position (see FIG. 15) to the second position (see FIG. 16). When in the second position, the extension 103 (particularly the distal edge 116) of each cam 102 defines the maximum fill level for print media 200 within the feed tray 20, and thereby limits the amount of print media 200 that may be inserted therein.

More particularly, as shown in FIG. 17, during a loading sequence or operation for feed tray 20 (see FIGS. 1 and 2), a user inserts a stack of print media 200. Upon initially entering the feed tray 20, the print media 200 (or some portion thereof) engages with each cam 102 (that is the cam 102 on first side guide 50 and the cam 102 on second side guide 52—see FIG. 2). Specifically, the print media 200 engages with the extension 103 on each cam 102 (e.g., along concave arcuate surface 118), and the load imparted by the print media causes each cam 102 to deflect rotationally from the first position (see FIGS. 15 and 17) to the second position (see FIGS. 16 and 18).

Once each cam 102 is in the second position as shown in FIG. 18, planar surface 112 on each cam 102 is fully engaged with the corresponding projection 70 extending from planar surface 68 on guide wall 64 so that further deflection of each cam 102 (and extension 103) is prevented. Accordingly, once each cam 102 has reached the second position of FIG. 18, the print media 200 is separated by extension 103 into a first portion 205 and a second portion 210. The first portion 205 is of a sufficient size (or height) to fit between distal edge 116 of each cam 102 and surfaces 56, 26, while the second or remaining portion 210 is deflected away from surfaces 56, 26 via concave arcuate surface 118 on each cam 102. Therefore, the cams 102 on side guides 50, 52 permit the first portion 205 of print media 200 to advance along support surface 26 (and planar base surface 56) into feed tray 20, while preventing entry of second portion 210. Thus, when cams 102 are in the second position of FIG. 18, the height $H_{200}$ of respective distal edges 116 above planar base surface 56 of base 53 (and thus also support surface 26) defines the maximum fill level (or the maximum stack height) for print media 200 within printer tray 20. Accordingly, fill indicators 100, particularly cams 102 on side guides 50, 52, provide a physical barrier within feed tray 20 that prevents (or at least restricts) a user from inserting additional print media into tray 20 above the predetermined maximum fill height $H_{200}$.

Referring specifically to FIGS. 17 and 18, following the removal of second portion 210 of print media 200 from feed tray 20, the load provided on the cams 102 of side guides 50, 52 by the print media 200 is removed. As a result, each cam 102 rotates back from the second position (see e.g., FIGS. 16 and 18) to the first position due to the torsional bias provided by corresponding torsion spring 130 in the manner described above (see e.g., FIGS. 15 and 19). Accordingly, distal edge 116 of each cam 102 is rotated away from the first portion 205 of print media 200 disposed within tray 20, thereby leaving a gap $H_{205}$ between the uppermost piece of print media 200 within first portion 205 and distal edge 116 and planar surface 114 of each cam 102. During a subsequent printing operation, as pieces (e.g., pages) of print media 200 are drawn into opening 14 in housing 12 of printer 10 from tray 20 (see FIG. 1), gap $H_{205}$ helps to ensure minimal or no contact between the print media 200 and the cam 102 (particularly planar surface 114 and distal edge 116). Therefore, any contact friction that may be imparted to the print media 200 by fill indicators 100 (e.g., cams 102) on side guides 50, 52 during a printing operation is eliminated, even when tray 20 is filled to maximum fill height $H_{200}$.

In addition, during a subsequent printing operation, the cams 102 (particularly planar surface 114) may function as a de-skew tab within feed tray 20. Specifically, as pieces of print media 200 are pulled or drawn from first portion 205 into printer 10 (see FIG. 1), the print media 200 may (e.g., due to the engagement with the feed rollers or other feeding components) lift or elevate within feed tray 20. However, the vertical lift of the print media 200 is curtailed or limited by the engagement of the piece of print media 200 and planar surface 114 on each cam 102. Accordingly, cams 102 may prevent additional skewing or deflection of the print media during such operations. As a result, it should be appreciated that, in this example, feed tray 20 does not include additional de-skew tabs or extensions (that is, in addition to fill indicators 100).

Figure 20:
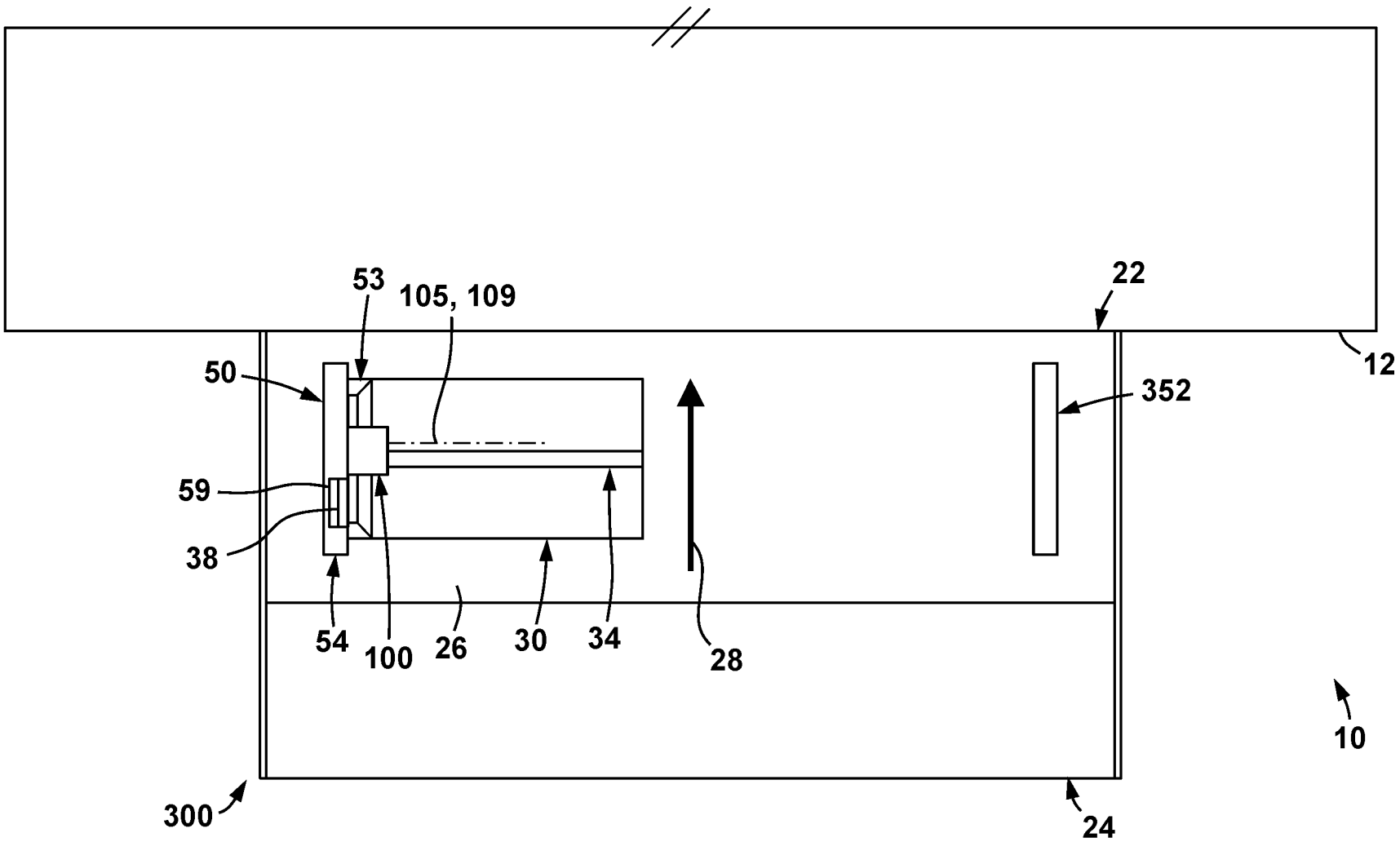
FIG. 20 is a schematic top view of another example of a printer tray according to some examples.

While examples disclosed herein have included printer trays having a pair of side guides that each include a fill indicator 100, it should be appreciated that other examples may include a single fill indicator 100 within feed tray 20. For example, referring now to FIG. 20, another example feed tray 300 for a printer (e.g., printer 10 in FIG. 1) is shown. Feed tray 300 is substantially the same as feed tray 20 previously described, except that feed tray 300 includes a second side guide 352 in place of second side guide 52. Second side guide 352 does not include a fill indicator 100. However, in this example, feed tray 300 includes first side guide 50, which does include a fill indicator 100 as previously described above. In addition, in this example, first side guide 50 is to move along support surface 26 as previously described above, while second side guide 352 is fixed relative to support surface 26. In still other examples, second side guide 352 may be omitted all together. Loading of print media 200 within feed tray 300 is substantially the same as for feed tray 20, previously described, except that the print media 200 (see FIGS. 17-19) engages with the single fill indicator on first side guide 50 rather than the pair of fill indicators 100 coupled to side guides 50, 52 as previously described above for feed tray 20 (see FIG. 2). Thus, a detailed discussion of this process is omitted in the interest of brevity.

Moreover, the examples disclosed herein have included fill indicators 100 for use within an external feed tray 20 on a printer housing 12 (see FIGS. 1 and 2). However, it should be appreciated that in other examples, the fill indicators 100 and side guides (e.g., side guides 50, 52) may be utilized within an internal feed tray for a printer (e.g., such as a cassette tray disposed within housing 12 of printer 10). Therefore, the discussion above regarding external feed tray 20 should not be interpreted as limiting the use of the disclosed fill indicators 100 to this single type of feed tray for a printer.

The examples disclosed herein having included feed trays for printers that include fill indicators (e.g., fill indicator 100) for physically preventing or at least restricting the insertion of print media into the tray above a predetermined maximum fill level. Thus, through the use of the examples disclosed herein, the risk of jamming or skewing of the print media as a result of overfilling the feed tray is reduced (or eliminated). In addition, some of the example fill indicators disclosed herein do not contact the print media (e.g., print media 200) after it has been fully loaded within the printer tray. As a result, friction imparted to the print media by the fill indicators during a subsequent printing operation is eliminated or reduced.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. A feed tray for a printer, the feed tray comprising:

a support surface to support print media;

a guide wall coupled to the support surface, wherein the support surface and the guide wall define a feed path for the print media into the printer, wherein the guide wall is movable along the support surface in a direction that is perpendicular to the feed path; and a fill indicator comprising a cam rotatably coupled to the guide wall about an axis of rotation that is perpendicular to the feed path, wherein the cam includes an extension that extends radially from the axis of rotation;

wherein the cam is rotatable about the axis of rotation between a first position and a second position, wherein the extension is more proximate to the support surface when the cam is in the second position than when the cam is in the first position, and wherein the cam is rotationally biased from the second position toward the first position.

2. The feed tray of claim 1, wherein the extension of the cam comprises:

a concave arcuate surface;

a distal edge; and a planar surface;

wherein the concave arcuate surface and the planar surface each extend away from the axis of rotation to the distal edge.

3. The feed tray of claim 2, wherein the planar surface is disposed between the concave arcuate surface and the support surface.

4. The feed tray of claim 1, comprising a projection that extends from the guide wall, wherein when the cam is in the second position, the cam is engaged with the projection.

5. The feed tray of claim 1, wherein the cam is rotationally biased from the second position toward the first position by a torsion spring coupled to the cam and the guide wall.

6. The feed tray of claim 5, comprising a shaft extending from the guide wall along the axis of rotation, wherein the cam and the torsion spring are disposed about the shaft.

7. A feed tray for a printer, the feed tray comprising:

a support surface to support print media;

a guide wall coupled to the support surface, wherein the support surface and the guide wall define a feed path for the print media into the printer, wherein the guide wall is to move perpendicularly to the feed path relative to the support surface; and a fill indicator coupled to the guide wall, wherein the fill indicator comprises:

a cam rotatably coupled to the corresponding guide wall about an axis of rotation that is perpendicular to the feed path, wherein the cam comprises an extension that extends outward from the axis of rotation to a distal edge;

wherein the cam is rotatable about the axis of rotation between a first position and a second position, wherein the distal edge is more proximate to the support surface when the cam is in the second position than when the cam is in the first position, and wherein the cam is rotationally biased from the second position toward the first position.

8. The feed tray of claim 7, wherein the extension of the cam comprises a concave arcuate surface and a planar surface, wherein the concave arcuate surface and the planar surface each extend away from the axis of rotation to the distal edge.

9. The feed tray of claim 8, wherein the planar surface is disposed between the concave arcuate surface and the support surface.

10. The feed tray of claim 9, comprising a projection that extends from the guide wall, wherein when the cam is in the second position, the cam is engaged with the projection.

11. The feed tray of claim 10, wherein the cam comprises a rear planar surface that is disposed on a radially opposite side of the axis of rotation from the distal edge, wherein the rear planar surface engages with the projection when the cam is in the second position.

12. The feed tray of claim 11, wherein the cam is rotationally biased from the second position toward the first position by a torsion spring coupled to the cam and the guide wall.

13. A feed tray for a printer, the feed tray comprising:

a support surface to support print media;

a guide wall coupled to the support surface, wherein the support surface and the guide wall define a feed path for the print media into the printer, wherein the guide wall is to move perpendicularly to the feed path relative to the support surface; and a fill indicator coupled to the guide wall, wherein the fill indicator comprises a cam rotatably disposed about a shaft extending from the corresponding guide wall along an axis of rotation that is perpendicular to the feed path;

wherein the cam comprises an extension that extends outward from the axis of rotation to a distal edge and comprises a concave arcuate surface extending from distal edge;

wherein the cam is rotatable about the shaft between a first position and a second position;

wherein the distal edge is more proximate to the support surface when the cam is in the second position than when the cam is in the first position, and the cam is rotationally biased from the second position toward the first position; and wherein the arcuate concave surface is to engage with print media that is loaded into the feed tray to transition the cam from the first position toward the second position.

14. The feed tray of claim 13, comprising a projection that extends from the guide wall;

wherein the cam comprises a rear planar surface that is disposed on a radially opposite side of the axis of rotation from the distal edge; and wherein, when the cam is in the second position, the rear planar surface is engaged with the projection.

* * * * *